United States Patent [19]

Constantinescu

[11] 4,167,356

[45] Sep. 11, 1979

[54] ROADWAY STRUCTURES

[75] Inventor: Victor Constantinescu, Braila, Romania

[73] Assignee: Consiliul Popular al Judetului Braila, Braila, Romania

[21] Appl. No.: 772,447

[22] Filed: Feb. 28, 1977

Related U.S. Application Data

[63] Continuation-in-part of Ser. No. 675,181, Apr. 8, 1976, abandoned, which is a continuation of Ser. No. 527,014, Nov. 25, 1974, abandoned.

[51] Int. Cl.[2] ..... E01C 3/00

[52] U.S. Cl. ..... 404/31

[58] Field of Search ..... 404/27, 31, 17, 81, 404/82

[56] References Cited

U.S. PATENT DOCUMENTS

| | | | |
|---|---|---|---|
| 683,056 | 9/1901 | Malette | 404/81 |
| 984,801 | 2/1911 | Davis | 404/81 |
| 1,110,295 | 9/1914 | Phillips | 404/70 |
| 1,531,466 | 3/1925 | Welch | 404/70 |
| 1,546,540 | 7/1925 | Hunt | 404/82 |
| 1,729,884 | 10/1929 | MacKenzie | 404/82 |
| 2,078,485 | 4/1937 | Dunham | 404/31 |
| 2,083,900 | 6/1937 | Ebberts | 404/31 |
| 2,115,667 | 4/1938 | Ellis | 404/70 |
| 2,165,437 | 7/1939 | Adam | 404/28 X |
| 2,333,287 | 11/1943 | Baird | 404/27 X |
| 2,353,027 | 7/1944 | Goodwin | 404/28 |
| 3,112,681 | 12/1963 | Gessler | 404/31 |

*Primary Examiner*—Nile C. Byers, Jr.

[57] ABSTRACT

An improved three-layer slab supported by a reduced-thickness elastic foundation for roadway applications is described. The intermediate layer of the slab is significantly thicker and more porous than each of the adjacent upper and lower layers, and serves as a thermo-insulating layer to prevent the propagation of extremely low temperatures to the elastic foundation of the slab. The slab has a thickness significantly greater than that of the foundation. Typically, the upper and the lower layers of the slab are formed from poured asphaltic concrete, while the intermediate layer is formed from compacted natural crushed stone or granulated broken stone sprayed with fluid bituminous or a bituminous-gasoline mixture.

4 Claims, 4 Drawing Figures

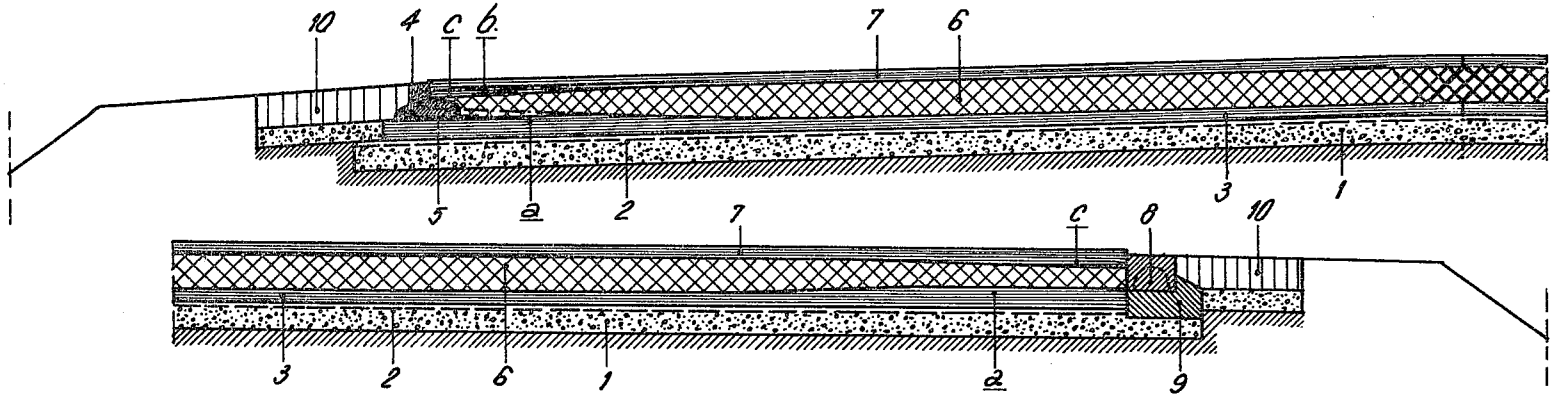
FIG. 1.
FIG. 1a.
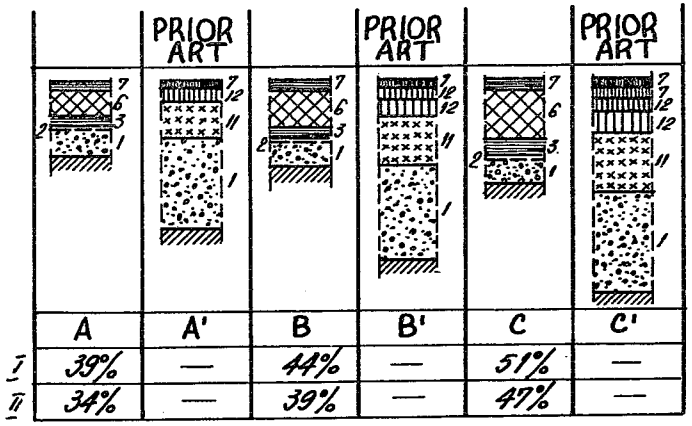
FIG. 3.
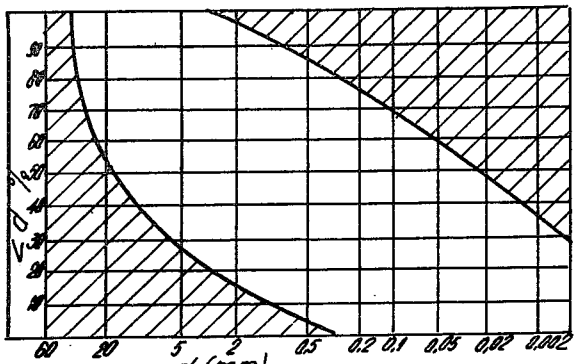
FIG. 2.

ROADWAY STRUCTURES

CROSS-REFERENCE TO RELATED APPLICATIONS

This application is a continuation-in-part of application Ser. No. 675,181, filed Apr. 8, 1976 which is in turn a continuation of application Ser. No. 527,014 dated Nov. 25, 1974, both now abandoned.

BACKGROUND OF THE INVENTION

The invention relates to roadway structures in the form of continuous multi-layer composite slabs that are supported by an elastic foundation.

One known arrangement of this type is described in U.S. Pat. No. 2,083,900. In such arrangement, a three-layer slab is described wherein the superposed layers are all approximately equal in thickness (e.g., 1–2 inches). Additionally, the porosity of the composite layer of the structure described in such patent decreases progressively from the lower to the upper layers of the structure.

One disadvantage of such known structure is that, because of the relatively high porosity of the lowermost layer of the slab, water and mud in the underlying foundation are permitted to seep upwardly through the several layers of the slab, thereby exerting a weakening effect thereon. In addition, with the successively increasing porosity of the slab toward the bottom thereof, extremely low atmospheric temperatures can rather easily propagate from the surface of the slab down to the foundation, thereby setting up a destructive freezing-thawing phenomenon.

SUMMARY OF THE INVENTION

Such disadvantages are overcome with the improved, three-layer slab roadway structure of the present invention. In an illustrative embodiment, the intermediate layer of the slab is made significantly more porous and thick than each of the upper and lower layers, so that the intermediate layer will serve as an effective thermo-insulating layer for the composite slab to prevent the penetration of low ambient temperatures, e.g., temperatures below 0° F., from the roadway surface to the underlying elastic foundation, thereby effectively avoiding the above-mentioned destructive freezing-thawing phenomenon. Moreover, because of the high density (e.g., low porosity) of the lower layer relative to the overlying intermediate layer, the migration of water and mud from the foundation into the slab is effectively inhibited.

Advantageously, the lower layer of the composite slab is formed from a poured asphaltic concrete having a porosity less than 6%. The intermediate layer is typically compacted, calibrated natural crushed stone or granulated broken stone, sprayed with fluid bituminous or a bituminous-gasoline mixture. The upper layer, like the lower layer, may be formed of poured asphaltic concrete, and has a porosity less than 15%.

In relative terms, the upper layer may constitute about 15–25% of the total slab thickness; the intermediate layer, 55–75%; and the lower layer, 10–20%.

BRIEF DESCRIPTION OF THE DRAWING

The invention is further set forth in the following detailed description taken in conjunction with the appended drawing, in which:

FIG. 1 is a fragmentary vertical section through a first embodiment of a roadway structure in accordance with the invention;

FIG. 1*a* is a fragmentary vertical view of a second embodiment of roadway structure in accordance with the invention;

FIG. 2 is a graph illustrating a percentage distribution, by particle size, of natural crushed stone particles suitable for use in the intermediate layer of the composite three-layer slab of the roadway of FIG. 1 or FIG. 2; and FIG. 3 is a schematic comparative representation of three illustrative roadway constructions A, B and C in accordance with the invention juxtaposed with three corresponding prior art roadway constructions A', B' and C', respectively, giving the comparative savings in cost of construction and fuel consumption provided in each case by the inventive structures.

DETAILED DESCRIPTION

Referring now to the drawing, FIG. 1 illustrates an illustrative roadway construction including an elastic foundation 1, which may be formed of well-compacted stone and which may have a thickness lower than that typically employed in similar constructions; in particular, the thickness of the foundation 1 may be in the order of 10–15 cm.

The upper surface of the foundation 1 is coated with a thin layer 2 of crushed stone, whose particles may exhibit a diameter of 1–1.15 cm on the average. The total thickness of the layer 2 on the foundation 1 is in the range of 1–2 cm.

A composite, three-layer slab, constructed in accordance with the invention, overlies the coated foundation 1. The thickness of the composite slab is significantly greater than that of the foundation 1. Typically, the thickness of the slab is in the range of 15–35 cm.

The lower layer (designated 3) of the composite slab is preferably formed from a cohesive, substantially impermeable material of high mechanical strength, such as poured asphaltic concrete having a porosity less than 6%, and preferably in the 3–4% range. The binder employed in the concrete may be bituminous, of such composition as to have a penetrability in the 50–100 range.

Because of the extremely low porosity of the layer 3, water and mud are effectively prevented from migrating upwardly from the foundation 1 into the interior of the composite slab.

As alternative materials for the layer 3, dense polymeric concrete or compact cement concrete can be used; in any case, the employed concrete may be plain or reinforced, with the reinforcement consisting, e.g., of polyester or steel wire mesh.

The thickness of the layer 3 should be about 10–20% of the total slab thickness. In the event that reinforcements are employed in the concrete, it is possible to reduce the thickness, but not beyond the point where the layer becomes permeable to the water and mud in the foundation.

As shown in FIG. 1, it may be preferable to locally thicken the layer 3 in the area of the curb of the roadway, as illustrated at a. Such thickened portions provide adequate support for an overlying framing curb 4, which may be formed from cement concrete. A layer 5 of asphalt mortar may be disposed between the lower surface of the curb 4 and the upper surface of the thickened portion a of the layer 3. Advantageously, the curb 4 may further be connected to the roadway by wire reinforcements b, to provide a supplementary anchorage of the curb 4 in the composite slab.

An intermediate layer 6 of the composite slab is formed from a material which may have a lower mechanical strength, and thereby a lower cost, than the material of the underlying layer 3. The thickness and porosity of the layer 6 is, in accordance with the invention, made much greater than that of the underlying layer 3 and the overlying top layer (designated 7) of the composite slab, so that such intermediate layer can constitute an effective thermo-insulating layer that prevents sub-zero ambient temperatures above the slab from propagating downwardly through the slab to the foundation, thereby subjecting the latter to the destructive phenomenon of successive freezing and thawing.

Illustratively, the material of the layer 6 may be compacted natural crushed stone having particles distributed in the 40–60 mm range, with the percentage distribution of the various sized particles conforming, e.g., to the curve of FIG. 2. Alternatively, granulated broken stone or sandy or clay earth found in the environment of the road-building area may be employed. The stone of the layer 6 may advantageously be presprayed with fluid bituminous or a bituminous-gasoline mixture. The relative thickness of the layer 6 is made about 55–75% of the total thickness of the composite slab. In addition, the material of the layer 6 should exhibit a porosity in the 12–50% range (illustratively 20%), with a binder penetration in the 150–250 range.

The upper layer 7, like the lower layer 3, should be made of a cohesive impermeable material such as dense, poured asphaltic concrete or polymeric concrete, with a porosity less than 15% (typically 2–4%) and a binder with a penetrability in the 30–70 range. The upper layer 7, like the lower layer 3, exhibits locally thickened zones c (FIG. 1) in the vicinity of the curb 4, in order to sustain the increased stresses in these areas. (As indicated, a road shoulder 10 can serve as an effective buttress for the curb 4 against the stresses imposed at the locally increased thickness portion c.

The roadway structure shown in FIG. 1*a* is substantially similar to that shown in FIG. 1, except for the manner of construction of the curb itself. Thus, in FIG. 1*a*, conventional curbs 8 are laid, on the right-hand edge of the roadway, on a foundation 9 of cement concrete, which abuts the thickened right-hand portion a of the bottom layer 3.

FIG. 3 illustrates the results of a comparative study between three typical constructions A, B and C in accordance with the invention, and corresponding prior-art roadways A′, B′ and C′. The corresponding roadways A, B and C and A′, B′ and C′, respectively, differ from each other in their load-bearing capacities, with the roadways A, A′ being light-duty, the roadways B, B′ being medium-duty, and the roadways C, C′ being heavy-duty.

As indicated in the tables in the lower part of FIG. 3, the light-duty roadway A achieved a cost saving of 39% and a fuel saving of 34% as compared to the corresponding prior-art roadway A′. In like manner, the medium-duty roadway B achieved a cost saving of 44% and a fuel saving of 39% as compared to the corresponding prior-art roadway B′. Also, the heavy-duty roadway C achieved a cost saving of 51% and a fuel saving of 47% as compared to the corresponding prior-art roadway C′.

Such cost and fuel savings exhibited by the structures of the invention are due, in part, to the reduced foundation thickness allowable with the novel composite three-layer overlying slab of the invention. In addition, it has been found that the working life of the roadways of the invention, and the periods between required maintenance over long periods of use, are much greater in the case of the inventive structures than in the case of the prior-art structures.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a roadway structure comprising an elastic foundation and a continuous, composite multi-layer slab overlying and supported by the foundation, the slab having lower, intermediate and upper layers successively bounded together, the improvement wherein the porosity and thickness of the intermediate layer is significantly greater than that of the upper and lower layers to form a thermo-insulating barrier therebetween, the total thickness of the slab being significantly greater than the thickness of the foundation; the lower layer being 10%–20% of the thickness of the slab; the thickness of the intermediate layer being 55%–75% of the the thickness of the slab; the thickness of the upper layer being 15%–25% of the thickness of the slab; the upper and lower layers being from a material having a porosity of about 4% and being selected from the group consisting of asphalt concrete, polymer concrete and compact cement concrete.

2. A roadway structure as defined in claim 1, in which the upper and lower layers are formed from a material selected from the group consisting of asphalt concrete, polymer concrete and compact cement concrete, the upper layer having a porosity of 2–4%, the lower layer having a porosity of 3–4%.

3. A roadway structure as defined in claim 2, in which the lower layer is reinforced with a mesh of a material selected from the group consisting of steel and polyester.

4. A roadway structure as defined in claim 2, in which the slab has a total thickness which is at least twice as great as that of the foundation.

* * * * *